United States Patent [19]

Lingemann

[11] Patent Number: 4,597,232

[45] Date of Patent: Jul. 1, 1986

[54] CURVED CORNER OF A SPACER FRAME OF AN INSULATING GLAZING, AND A PROCESS FOR THE PRODUCTION THEREOF

[75] Inventor: Horst Lingemann, Wuppertal, Fed. Rep. of Germany

[73] Assignee: Helmut Lingemann GmbH & Co., Fed. Rep. of Germany

[21] Appl. No.: 630,749

[22] Filed: Jul. 13, 1984

[30] Foreign Application Priority Data

Jul. 16, 1983 [DE] Fed. Rep. of Germany ..... 3325718

[51] Int. Cl.[4] ..... E06B 3/24

[52] U.S. Cl. ..... 52/304; 52/172; 52/658; 29/469.5

[58] Field of Search ..... 52/172, 398, 399, 631, 52/658, 788, 789, 790, 304; 29/469.5, 155 R

[56] References Cited

U.S. PATENT DOCUMENTS

| | | | |
|---|---|---|---|
| 3,380,145 | 4/1968 | Stroud et al. | 29/411 |
| 3,994,109 | 11/1976 | Pandell | 52/790 X |
| 4,073,177 | 2/1978 | Leroux | 52/658 X |
| 4,322,926 | 4/1982 | Wölflingseder et al. | 52/398 X |

FOREIGN PATENT DOCUMENTS

| | | | |
|---|---|---|---|
| 3715 | 1/1979 | European Pat. Off. . | |
| 2216038 | 10/1973 | Fed. Rep. of Germany | 52/172 |
| 3233399 | 3/1984 | Fed. Rep. of Germany . | |

*Primary Examiner*—Alfred C. Perham
*Assistant Examiner*—Jean M. Lakemper
*Attorney, Agent, or Firm*—Goodman & Teitelbaum

[57] ABSTRACT

A curved corner bent from a hollow-profile construction to form a spacer frame of an insulating glazing, where an opening is provided in the inner wall and in the side walls of the hollow-profile construction in the corner zone, so that a free transverse edge on one side of the opening clamps over a free end portion on an opposite side of the opening when the hollow-profile construction is bent at a right angle to form the curved corner, and a process for the production of the corner, in which the opening is a rectangular cut-out into the inner wall and U-shaped cut-outs cut into the side walls, where the side walls are braced during the bending in such a way that the free transverse edge is guided onto the free end portion to provide flat side surfaces on the curved corner after the bending thereof.

7 Claims, 4 Drawing Figures

CURVED CORNER OF A SPACER FRAME OF AN INSULATING GLAZING, AND A PROCESS FOR THE PRODUCTION THEREOF

BACKGROUND OF THE INVENTION

The invention relates to a curved corner of a spacer frame of an insulating glazing, and further to a process for the production of the new corner.

A curved corner of this general type is known in the prior art, as disclosed in EP-OS No. 0 003 715. In this known corner, one disadvantage is that fillets are disposed between the incisions, which leads to undesired and uncontrollable deformations in the corner zone. These deformations may be, for example, concave or convex archings in the inside wall of the side walls thereof, so that there are no flat side surfaces provided in the region of the curved corner, for example, for receiving the surrounding butyl strips or similar sealing agents. Level surfaces, especially in the corner zone, however, are an important precondition for assuring the sealing, with the required quality, of the inner space of the insulating glazing against the outer atmosphere.

Level surfaces can be obtained, to be sure, in a curved corner according to the prior art, as disclosed in U.S. Pat. No. 3,380,145, in which mitering incisions are generated. However, the rigidity of the curved corner of this latter patent is very slight, because the corner zone is held exclusively with the outer wall. It is noted, that this slight rigidity considerably impairs the handling of the frame having such curved corners.

German Patent Application No. P 32 33 399.4 teaches that the abutting edges of the frame can be solidly joined by injecting a stopper and/or plug into the curved corner.

SUMMARY OF THE INVENTION

An object of the present invention is to provide a curved, very rigid corner having flat side surfaces and flat surfaces on the inside walls thereof, wherein the production of the corner is simple.

In order to achieve the above object, the present invention includes a spacer frame of an insulating glazing having curved corners, the spacer frame being constructed from a hollow-profile construction having an inside wall, side walls and an outer wall. An opening is provided in the inside wall at each corner zone so that the opening extends into each of the side walls. In each corner zone, a free transverse edge of one inside wall, as defined by the opening, clamps over a free end of an adjacent inside wall extending at right angles to the one inside wall.

BRIEF DESCRIPTION OF THE DRAWING

With the above and additional objects, and advantages in view, as will hereinafter appear, this invention comprises the devices, combinations and arrangements of parts hereinafter described by way of example and illustrated in the accompanying drawing of a preferred embodiment in which.

DETAILED DESCRIPTION OF THE PREFERRED EMBODIMENT

Figure 1:
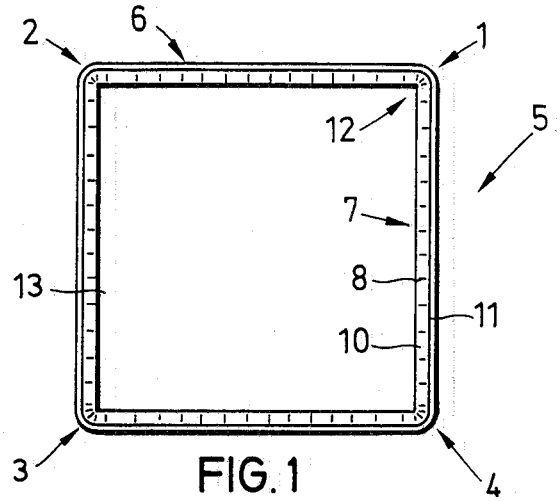
FIG. 1 shows schematically a side view of a spacer frame having a hollow-profile structure for an insulating glazing.

The preferably one-piece spacer frame, constructed from a hollow-profile structure, is filled with a drying and adsorption agent. The spacer frame 5 includes four curved corners 1, 2, 3 and 4, which are formed alike, as shown in FIG. 1. In the zone of the abutting edges 6, the frame 5 is solidly joined, for example, according to the teaching of the German Patent Application No. P 32 33 399.4, by an injected plug and/or stopper (not shown). In the side wall 7, as shown in FIG. 2, the frame 5 has two holes 8, known per se, which make possible a gas exchange between the interior of the insulating glazing and the above mentioned drying and adsorption agent disposed in the cavity of the hollow-profile structure of the frame 5.

Figure 2:
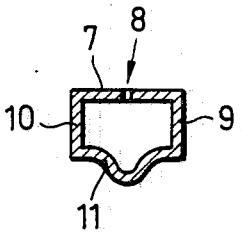
FIG. 2 shows schematically a cross section through the hollow-profile structure.

The hollow-profile structure of the spacer frame 5 includes opposing flat side walls 9 and 10, a flat inside wall 7 arranged at a right angle to the side walls, and a curved outer wall 11, as shown in FIG. 2.

Figure 4:
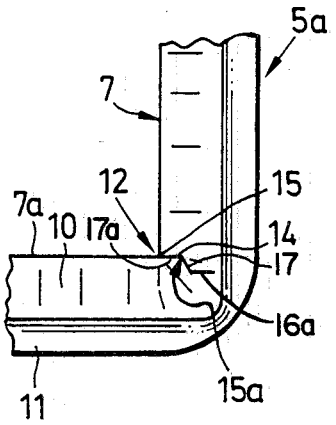
FIG. 4 shows a curved corner of the spacer frame.

It is essential that, in the corner zone 12 of the inner frame portion 13 of the spacer frame 5, the free transverse edge 15 of the inside wall 7 clamps over a free end portion 14 of the inside wall **7*a* extending at a right angle to the inside wall 7, as shown in FIG. 4, so that the portion 14 comes to lie within the interior of the hollow-profile structure of the spacer frame 5. In the bending of the corner, care must be taken so that the flat surfaces remain preserved on the side walls disposed in the corner zone 12**.

Figure 3:
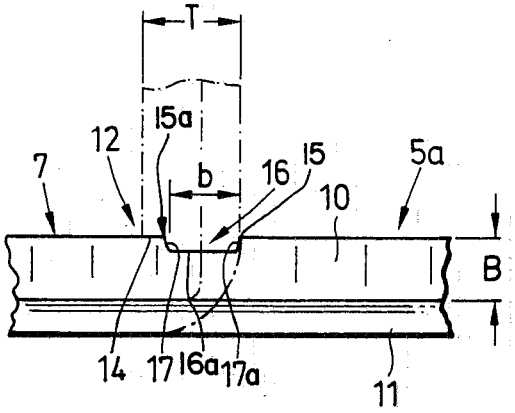
FIG. 3 shows a side view of a corner zone to be bent into the hollow-profile structure.

The above structure of the present invention is achieved by providing an opening 16, preferably by milling a cut-out into the hollow-profile structure **5*a*, as shown in FIG. 3. The opening 16 extends into the side walls 9, 10, and preferably provides a rectangular aperture in the wall 7 as viewed from top, and as viewed from the side as shown in FIG. 3, provides an angular U-shaped aperture in the side walls 9 and 10**.

The opening 16 should have a length "b" which is less than the depth "T" of the hollow-profile structure **5*a*, as shown in FIG. 3. The difference or the excess provides the free end portion 14. The ratio of "b" to "T" amounts preferably to 1:1.1 to 1:1.5. The depth of the angular U-shaped aperture of the opening 16 in the side walls 9, 10 is preferably deeper than the wall thickness of the hollow-profile structure 5*a*, this depth amounting preferably to the 0.1th to 0.5th part of the width "B" of the walls 9, 10, as shown in FIG. 3**.

According to a special form of the present invention, the opening 16 is the side walls 9, 10 provides, as viewed from the side in FIG. 3, an angular U-shaped aperture having a base edge **16*a* and side edges 17 and 17*a* which diverge away from each other towards the wall 7**.

The length "b", as well as the slope of the edges 17 and **17*a*, and the depth of the angular U-shaped aperture of the opening 16 in the side wall 9, 10 are attuned to one another in such a way that, in the bent corner in the side walls 9, 10, insofar as possible, there are present no holes resulting from the cut-out for the opening 16 in the side walls, i.e. the side walls form, also in the corner zone, a flat, closed surface. This flat closed surface is achieved, in a surprising manner, by the above mentioned features of the present invention. It is advantageous, in this connection, if in the bending of the corner, care is taken that the side walls 9 and 10** are braced with a firm counter-support.

A process for the production of a corner, according to the present invention, is distinguished in that a rectangular cut-out is provided into the wall 7 of the hollow-profile structure 5*a*. The cut-out extends also partially into the side walls 9, 10, and there provides an angular U-shaped aperture in each side wall. Therefore, when the bending of the hollow-profile structure 5*a* is performed, preferably while bracing the side walls, the free transverse edge 15 of the wall 7 is brought, in such a way, onto the wall 7*a*. In this process, the free transverse edge 15*a* of the wall 7*a* is disposed at the end of the free end portion 14, so that the length of the free end portion or excess which extends from the free transverse edge 15*a* to a transverse segment, for example, can amount to about 1 to 3 mm. Thus, as shown in FIG. 4, the side edge 17*a* of each side wall is disposed on the end portion 14, and the base edge 16*a* of each side wall is bent onto itself.

Due to the fact that no material is present in the opening 16 and that the length "b" of the opening 16 is shorter than the depth "T" of the hollow-profile structure 5*a* forming the spacer frame 5, no squeezing zones are obtained in the bending thereof that could cause any bulging of the inside walls 7 and 7*a*, respectively, as shown in FIG. 4.

It is especially advantageous, if, according to the process described in German Patent Application No. P 32 33 399.4, a stopper and/or plug is injected into the curved corner, wherein the stability of the corner can be considerably increased. With the injection of a molten adhesive, any unevennesses in the walls of the hollow-profile structure can be pressed out in the corner zone.

Numerous alterations of the structure and/or process herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A spacer frame of an insulating glazing comprising:

said spacer frame being constructed from a hollow-profile construction having an inside wall, side walls and an outer wall, said walls having a predetermined wall thickness;

said spacer frame having at least one curved corner;

cut-out means disposed in a corner zone of said curved corner to include an opening through said inside wall and into a width of each side wall to provide a rectangular aperture in said inside wall and a U-shaped aperture in each side wall prior to forming the curved corner;

a first portion of said inside wall having a first free transverse edge disposed at said rectangular aperture, and a second portion of said inside wall having a second free transverse edge disposed at said rectangular aperture, said first and second free transverse edges being parallel to each other and being spaced apart by a first preselected length across said rectangular aperture;

said first portion of said inside wall extending at a right angle to said second portion of said inside wall, and said outer wall being curved to provide said curved corner;

said second portion of said inside wall including a free end portion extending a second preselected length from said second free transverse edge to a transverse segment of said second portion;

said first free transverse edge on said first portion clamping over onto said transverse segment of said second portion to provide said corner zone, with said free end portion of said second portion being disposed within a hollow interior of said curved corner;

each side wall having a base edge and first and second side edges disposed at its associated U-shaped aperture, said first and second side edges of each side wall being angularly disposed with respect to their associated base edge with said first and second side edges of each side wall diverging away from each other from their associated base edge toward said first and second free transverse edges of said inside wall respectively;

each of said first and second side edges having a depth length from said inside wall to their associated base edge which is deeper than said wall thickness of said hollow-profile construction; and said first side edge of each side wall being disposed on said free end portion of said second portion, and said base edge of each side wall being bent onto itself.

2. A spacer frame according to claim 1, wherein said hollow-profile construction includes means to permit a fusion adhesive to be injected into and fill said hollow interior of said curved corner for hardening to seat a plug formed thereby within said curved corner.

3. A spacer frame according to claim 1, wherein said first preselected length across said rectangular aperture and said second preselected length of said free end portion add together to provide a depth along said hollow-profile construction, wherein a ratio of said first preselected length across said rectangular aperture to said depth along said hollow-profile construction amounts to 1:1.1 to 1:1.5.

4. A spacer frame according to claim 1, wherein said depth length aperture amounts to 0.1 to 0.5 times said width of said side walls.

5. A process for production of a curved corner of a spacer frame on an insulating glazing, comprising:

providing a hollow-profile construction having an inside wall, side walls and an outer wall for forming the spacer frame, where the walls have a predetermined wall thickness;

cutting a cut-out into the inside wall to provide a first free transverse edge on one side of the cut-out and a second free transverse edge on an opposite side of the cut-out, so that a transverse segment on the opposite side of the cut-out is spaced from the second free transverse edge to provide a free end portion on the opposite side of the cut-out;

extending said cutting a predetermined depth into the side walls to cut a U-shaped aperture in each of the side walls to provide first and second side edges on opposite sides of each U-shaped aperture and a base edge disposed between each of the first and second side edges, so that the predetermined depth of cut is deeper than the wall thickness of the hollow-profile construction;

forming the first and second side edges of each side wall at an angle with respect to their associated base edge during the extending of said cutting, so that the first and second side edges of each side wall diverge away from each other from their associated base edge toward the first and second free transverse edges of the inside wall;

bending the hollow-profile construction so that the one side of the cut-out is at a right angle to the free end portion on the opposite side of the cut-out, and the outer wall is curved to provide the curved corner; and clamping the first free transverse edge over onto the transverse segment so that the free end portion is disposed within a hollow interior of the curved corner with the first side edge of each side wall being disposed on the free end portion, and so that the base edge of each side wall is bent onto itself.

6. A process according to claim 5, including injecting a fusion adhesive into the hollow interior of the curved corner to form a hardened plug which fills the interior of the curved corner.

7. A process according to claim 5, including bracing the side walls during said bending to guide said first free transverse edge onto said free end portion.

* * * * *